US012467345B2

(12) United States Patent
Shaw

(10) Patent No.: US 12,467,345 B2
(45) Date of Patent: Nov. 11, 2025

(54) WIRELESS GAS LIFT

(71) Applicant: Silverwell Technology Ltd., Cambridgeshire (GB)

(72) Inventor: Joel David Shaw, Houston, TX (US)

(73) Assignee: Silverwell Technology Limited, Cambridge (GB)

( * ) Notice: Subject to any disclaimer, the term of this patent is extended or adjusted under 35 U.S.C. 154(b) by 42 days.

(21) Appl. No.: 18/447,384

(22) Filed: Aug. 10, 2023

(65) Prior Publication Data

US 2024/0052731 A1 Feb. 15, 2024

Related U.S. Application Data

(60) Provisional application No. 63/397,459, filed on Aug. 12, 2022.

(51) Int. Cl.
*E21B 43/12* (2006.01)
*E21B 47/008* (2012.01)

(52) U.S. Cl.
CPC ..... *E21B 43/123* (2013.01); *E21B 47/008* (2020.05)

(58) Field of Classification Search
CPC ..... E21B 43/122; E21B 43/123; E21B 47/008
See application file for complete search history.

(56) References Cited

U.S. PATENT DOCUMENTS 5,959,547 A * 9/1999 Tubel ..... E21B 47/107 340/853.2
8,925,638 B2 1/2015 Wygnanski
2003/0164240 A1 9/2003 Vinegar et al.
2017/0226814 A1* 8/2017 Clemens ..... E21B 23/00
2018/0149002 A1* 5/2018 Murdoch ..... E21B 47/06
2021/0198988 A1 7/2021 Ramakrishnan et al.

FOREIGN PATENT DOCUMENTS

GB 2322885 A 9/1998
WO 1996024749 8/1996

OTHER PUBLICATIONS

Awang@Mohamed et al., "Successful Pilot of DIAL Digital & Interventionless Gas Lift Production Optimization System Offshore Malaysia", SPE-205763-MS, Oct. 2021.
International Search Report and Written Opinion for PCT Application No. PCT/GB2023/052130 dated Oct. 20, 2023. (STL042).

* cited by examiner

*Primary Examiner* — Kristyn A Hall
(74) *Attorney, Agent, or Firm* — Bracewell LLP; Keith R. Derrington

(57) ABSTRACT

A well system having a wellbore that intersects a subterranean formation, a valve station in the wellbore, and a primary controller on surface that communicates with the valve station using wireless telemetry. The valve station includes a valve member that controls a flow of fluid in the wellbore, an actuator for operating the valve member, and a valve controller that provides command signals to the actuator for positioning the valve member. The primary controller sends command signals that are receivable when the telemetry is operational. The valve controller is programmed to control operation of the valve actuator and valve member when telemetry is suspended and so that the valve station operates autonomously when out of signal communication with the primary controller and until signal communication is reestablished.

19 Claims, 6 Drawing Sheets

WIRELESS GAS LIFT

CROSS-REFERENCE TO RELATED APPLICATION

This application claims priority to and the benefit of U.S. Provisional Application Ser. No. 63/397,459, filed Aug. 12, 2022, the full disclosure of which is incorporated by reference herein in its entirety and for all purposes.

BACKGROUND OF THE INVENTION

1. Field of Invention

The present disclosure relates to controlling downhole systems with wireless telemetry.

2. Description of Prior Art

Lift systems for unloading liquids from a well include pumps, such as electrical submersible pumps ("ESP"), which pressurize the liquid downhole and propel it up production tubing that carries the pressurized fluid to surface. Sucker rods and plunger lift pumps are also sometimes employed for lifting liquid from a well. In wells having an appreciable amount of gas mixed with the liquid a two-phase fluid may form and gas is sometimes separated from the fluid upstream of the ESP and routed to surface separately from the pressurized liquid. In some instances, compressor pumps are employed to pressurize the two-phase fluid to lift it to surface. A gas lift system is another type of artificial lift system, and that injects a lift gas, typically from surface, into production tubing installed in the well. The lift gas is usually directed into an annulus between the production tubing and sidewalls of the well, and from the annulus into the production tubing. Gas lift is commonly employed when pressure in a formation surrounding the well is insufficient to urge fluids to surface that are inside of the production tubing. By injecting sufficient lift gas into the production tubing, static head pressure of fluid inside the production tubing is reduced to below the pressure in the formation, so that the formation pressure is sufficient to push the fluids inside the production tubing to surface. Fluids that are usually in the production tubing are hydrocarbon liquids and gases produced from the surrounding formation. Sometimes these fluids are a result of forming the well or a workover and have been directed into the production tubing from the annulus.

The lift gas is typically transported to the well through a piping circuit on surface that connects a source of the lift gas to a wellhead assembly mounted over the well. Usually, valves are mounted at various depths on the production tubing for regulating the flow of lift gas into the production tubing from the annulus. Some types of these valves automatically open and close in response to designated pressures in the annulus and/or tubing. An injection pressure operated ("IPO") gas lift valve is one type of automatic valve for injecting lift gas into production tubing. IPO valves are usually designed to close in response to pressure in the annulus, and with staggered closing pressures so the lowermost valve is set to close at the lowest annulus pressure. Production pressure operated ("PPO") gas lift valves are another type of automatic valve used for gas lift injection. PPO valves have staggered set pressures; but operate in response to pressure inside the production tubing rather than in the annulus, and with the lowermost valve closing at the highest set pressure. Another type of valve is motor operated and controlled by signals delivered from a remote location.

IPO and PPO gas lift systems are not controlled from surface, are unpredictable, and typically require being pulled from the well to adjustments to optimize the system. Current surface-controlled gas lift systems require a physical communications line to the surface, either hydraulic or electric, in order to be in continuous communication with the surface.

SUMMARY OF THE INVENTION

Disclosed herein is an example of a computer implemented method of operating a well system, which includes controlling operation of a lift gas valve unit that is disposed inside of a wellbore based on wireless communication received proximate the lift gas valve unit, monitoring inside the wellbore for a designated condition within the wellbore, and upon sensing the designated condition, autonomously controlling operation of the lift gas valve unit from within the wellbore. The designated condition includes a downhole operating scenario, such as, a suspension of the wireless communication, a reduction of pressure within production tubing in the wellbore indicating a loss of fluid production from the wellbore, pressure in the annulus indicating a blow down, an instruction received, and if pressure in the production tubing is greater than or substantially equal to pressure in an annulus outside the production tube in excess of a designated period of time. Examples of autonomously controlling operation of the lift gas valve unit include injecting lift gas based on pressure inside of production tubing in the wellbore, injecting lift gas based on pressure in an annulus outside the wellbore, unloading liquid from within the wellbore, communicating with sensors inside the wellbore, and combinations thereof. Autonomously controlling operation of the lift gas valve unit further optionally includes controlling the injection of lift gas based on pressure inside of production tubing in the wellbore, controlling the injection of lift gas based on pressure in an annulus outside the wellbore, and combinations thereof. In this example, controlling operation of the lift gas valve unit is based on information received from the sensors. In an alternative, monitoring is performed proximate the lift gas valve unit. In one example, the method further includes removing the lift gas valve unit from within the wellbore, installing a replacement lift gas valve unit in the wellbore having logics for autonomous operation, and communicating wirelessly with the replacement lift gas valve unit. In alternatives, the method further includes resuming control of operation of the lift gas valve unit based on wireless communication.

Also disclosed herein is an example of a non-transitory computer readable storage medium having executable code stored thereon for controlling an injection of lift gas into a wellbore, the executable code having instructions causing a processor inside a wellbore to perform operations including, monitoring for a designated condition within the wellbore, and controlling operation of a lift gas valve unit from within the wellbore when the designated condition is identified. Examples of the designated condition include a downhole operating scenario, such as, a suspension of the wireless communication, a reduction of pressure within production tubing in the wellbore indicating a loss of fluid production from the wellbore, pressure in the annulus indicating a blow down, an instruction received, and if pressure in the production tubing is greater than or substantially equal to pressure in an annulus outside the production tube in excess of a designated period of time. Examples of autonomously controlling operation of the lift gas valve unit include injecting lift gas based on pressure inside of production tubing in the wellbore, injecting lift gas based on pressure in an annulus outside the wellbore, unloading liquid from within the wellbore, communicating with sensors inside the wellbore, and combinations thereof. Autonomously controlling operation of the lift gas valve unit further optionally includes controlling the injection of lift gas based on pressure inside of production tubing in the wellbore, controlling the injection of lift gas based on pressure in an annulus outside the wellbore, and combinations thereof. Monitoring is optionally performed proximate the lift gas valve unit. The lift gas valve unit optionally includes a first lift gas valve unit, and wherein the executable code further includes instructions causing the processor to control a second lift gas valve unit. In an example, the executable code comprising instructions is updated by a wireless signal that is received in the wellbore.

An example of a well system is disclosed also, and that includes a communication system that provides selective communication between surface and inside a wellbore that intersects a subterranean formation, a processor in communication with the communication system, the processor disposed on surface outside the wellbore, and a valve station disposed in the wellbore. The valve station of this example includes a valve actuator, a valve member coupled with the valve actuator and selectively moveable in response to an operation of the valve actuator, and a valve controller in operational communication with the valve actuator and programmable with commands for autonomous operation of the valve actuator when out of communication with the processor. The communication system optionally includes wireless telemetry. In an alternative, the valve station is a first valve station, the well system further has a tubing encased conductor and a second valve station in communication with the first valve station via the tubing encased conductor. In an embodiment, one or more of the first and second valve stations are mounted on a tailpipe that depends from a straddle packer disposed in production tubing mounted in the wellbore. Examples of a valve member include a gas lift valve, an interval control valve, an inflow control device, and an outflow control device.

BRIEF DESCRIPTION OF DRAWINGS

Some of the features and benefits of the present invention having been stated, others will become apparent as the description proceeds when taken in conjunction with the accompanying drawings, in which.

Figure 1:
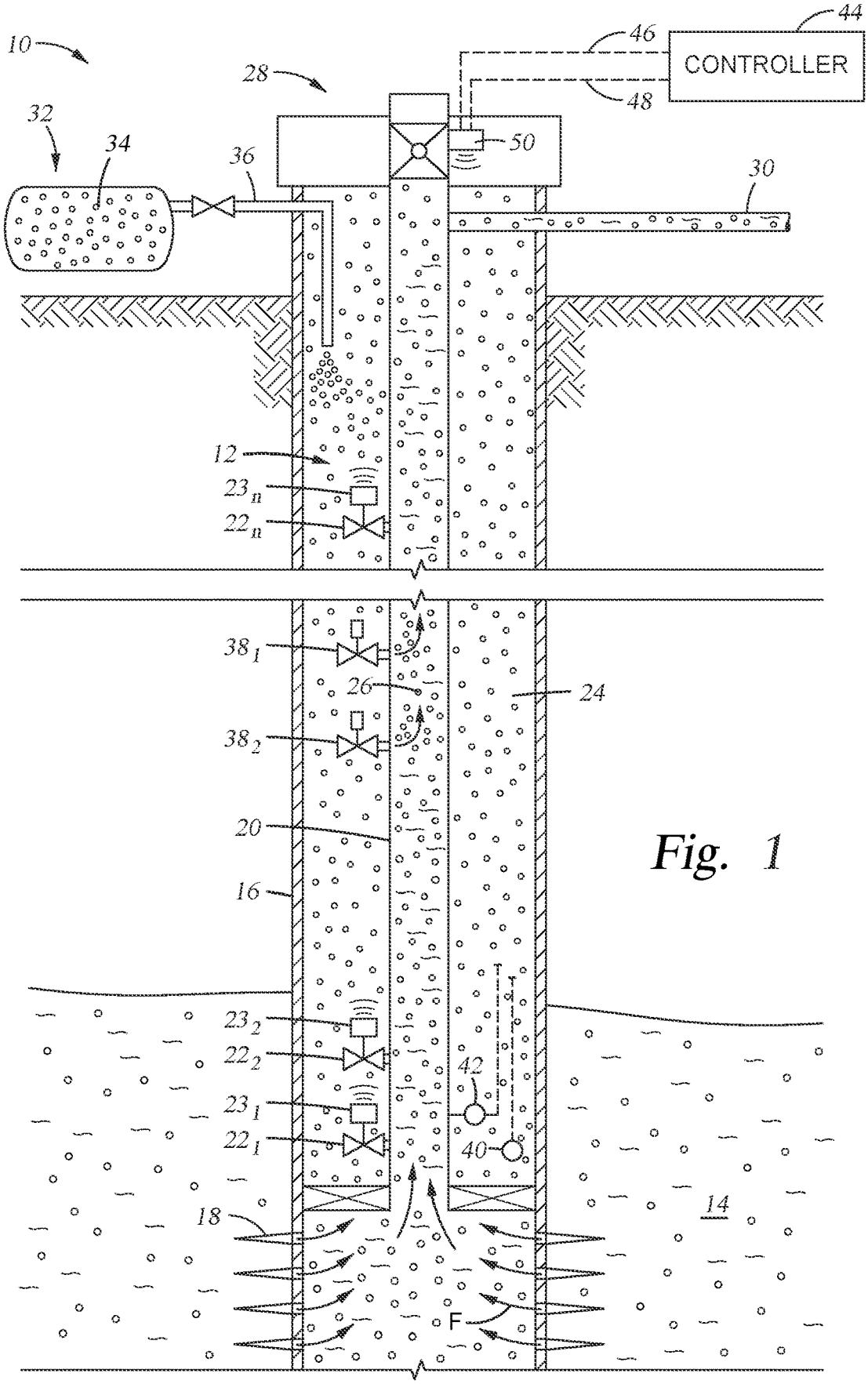
FIG. 1 is a side sectional view of an example of operation of a gas lift system in accordance with the present disclosure.

While subject matter is described in connection with embodiments disclosed herein, it will be understood that the scope of the present disclosure is not limited to any particular embodiment. On the contrary, it is intended to cover all alternatives, modifications, and equivalents thereof.

DETAILED DESCRIPTION OF INVENTION

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of a cited magnitude. In an embodiment, the term "substantially" includes +/−5% of a cited magnitude, comparison, or description. In an embodiment, usage of the term "generally" includes +/−10% of a cited magnitude.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

The present disclosure involves controlling a gas lift valve from the surface-controlled without a wired connection to the surface. This is an improvement over current surface-controlled gas lift systems that require a physical communications line to the surface, either hydraulic or electric. The present disclosure also provides an improvement over current IPO and PPO gas lift systems that are unpredictable and require being pulled from the well to adjustments to optimize the system, and is applicable for retrofit applications or those in which there are limited wellhead penetrations.

In examples of the system and method described herein, limited and discontinuous wireless communication is used to optimize and operate wells with surface-controlled gas lift systems. This is accomplished by automating some of the downhole behaviors and adjusting those behaviors from the surface. There are more complexities to consider, and those will be discussed later in this disclosure.

An example is to imitate the behavior of an IPO or a PPO gas lift valve. Each of these is set up at the surface before installation to open and close at certain pressures. This is typically accomplished by either adjusting a spring or gas charge, and the setpoints can change with temperature as well as the pressure opposite of its control pressure. Some problems include: (1) IPOs are supposed to open/close based on annulus pressure, but tubing pressure has some effect on the actual open/close pressures. (2) PPOs are supposed to open/close based on tubing pressure, but annulus pressure has some effect on the actual open/close pressures. (3) Gas lift valves Open % changes with absolute and differential pressures; may not be ideal. (4) Gas lift valves have some hysteresis, but not adjustable or ideal. (5) Gas lift valves are prone to chatter. (6) IPOs require a well design with a pressure reduction as injection passes each stage to make sure the valves close as gas is injected deeper into the well.

In current surface-controlled gas lift valves, the user at the surface can watch pressure and temperature data coming from downhole gas lift valves and make appropriate adjustments at the surface. This requires real time monitoring and control of the downhole components.

Many forms of telemetry exist to communicate from the bottom of a well to the surface. Some methods are more energy intensive and some less. Some are slower and others faster. Some with have a limited scope and some broader. In general, more energy intensive systems can travel through more complex mediums and can communicate data faster, less energy intensive systems are limited to simple mediums and transmit data slower.

For instance, cellular phones can transmit data very fast, but they are traveling through open air. If instead those signals had to travel through water, the data rate and electromagnetic signal would require much more power and be much slower. It is true that the same mode of communication is not required in both directions. For instance, a transmitter at the surface can have much more power than a transmitter downhole. Or in some situations, the downhole components may have the ability to add a pressure signal to the flow stream inside of the tubing. Furthermore, the data rates can change at various points in the well's life based on the flow and compositions of the fluids in the tubing and annulus. Additionally, all communication will be lost at some points in the well's life. The present disclosure utilizes some of the positive characteristics of an IPO or PPO valve, which are intended to operate automatically in response to downhole pressure and temperature, while still allowing an operator to adjust their behavior using limited and intermittent communication. Furthermore, it allows for a mechanism to reset functionality if the settings are adjusted beyond acceptable limits.

Known surface control systems have been proven in dozens of applications over the prior decade, but they require relatively fast closed loop control. Wireless communications schemes are readily available for communication between surface and downhole. However, they have limitations with respect to data rate, available mediums, available power, and distance. Some of the more available wireless technologies are only good for certain well scenarios, such as flowing during production. When production stops, these cease to be valid. The present disclosure allows the best features of surface control gas lift to be realized wirelessly despite the shortcomings of wireless technologies and the lack of communication at various stages in the life of the well.

The present disclosure relates to gas lifted wells that are controlled and optimized from the surface without need for a dedicated signal or control line to the surface. Surface control has thus far required a communication conduit to adjust downhole equipment from the surface and communicate information from downhole sensors back to the surface. This closed loop communication allows wells to be optimized taking into account feedback from downhole sensor or other decision making tools. This feedback loop required for surface control of downhole systems can happen very quickly with mechanical or electrical communication conduits, such as an electric or hydraulic lines between the surface system and the downhole components.

Instead of hard wired electrical or hydraulic lines, this system utilizes wireless communication. This disclosure is independent of the form of wireless communication. Instead, it accounts for the fact that some forms of low power wireless communication are quite slow. For a closed loop surface-controlled gas lift system to date, data must travel from the surface to the downhole equipment as well as from the downhole equipment up to the surface. A disruption of either can negatively affect production.

Because there is more power available at the surface, some forms of communication may transmit data downhole more quickly than data is transmitted back to the surface. In other scenarios, there might be significant power limitations restricting how quickly the downhole system can take readings to detect a pressure signal. If there is limited bandwidth in either leg of the closed loop, it can affect how well the system can optimize or even operate in a gas lifted well.

Furthermore, wells change over time. The fluids and phases change in both the tubing and annulus, the pressures diminish, flow slows, and wells are shut in. Different types of wireless telemetry may be optimal for each of these various stages, and those that are most universal can also have the slowest data rate. There may even be situations in which the chosen wireless communication method cannot communicate at all, such as shut-in. All situations over the life of the well are considered.

Some aspects of gas lift completions may offer advantages over other flow control intelligent completions when it comes to wireless technology. Regarding power for example, high pressure gas provides energy for power generation that needs to be shed anyway; and concerning telemetry, unloading valves can include repeaters to receive and retransmit a signal. However, some gas lift scenarios complicate wireless telemetry downhole. Varied combinations of shut-in, multiphase flow in the tubing, compressible and then incompressible fluids in the annulus, and salinity all complicate, slow, and block many forms of telemetry.

Non-Surface-Controlled Conventional Gaslift Equipment (IPOs and PPOs):

Conventional gas lift valves (IPOs and PPOs) do not require a feedback loop. Each reacts to downhole pressure and temperatures in a prescribed manner. However, they have problems such as multi-pointing, requiring unique calibration before running in hole that cannot be changed as the well changes, losing their calibration over time, not fully utilizing the pressure available at the surface, not being adjustable if the well parameters are not fully understood, cannot be optimized for the life of the well, etc. Therefore, conventional gas lift valves cannot provide an optimized production solution. To elaborate on wells with IPOs, they are each adjusted to close at subsequently lower pressures with each deeper IPO in the production string. Furthermore, there is a margin of error in setting these due to variations in temperatures, pressures, depths, densities, leakage, and other factors that might change over time. A safety factor usually is included in the set pressures to guarantee that valves will close and injection will work its way down the well as the density is reduced in the tubing. The net effect of the safety factory is to reduce the injection pressure available at the bottom of the well. This leads to reduced injection depth, less drawdown of the formation, and less production. PPOs also have their own problems. They can chatter, multipoint, allow reduced amounts of injected gas, and offer no feedback as to the depth of injection.

Surface-Controlled Gaslift:

Gas lift is a form of artificial lift technology that has been utilized for over 150 years. Relatively little significant development has occurred over the last quarter of that time, but surface-controlled gaslift is quickly bringing gas lift into a new era by enabling real time control and monitoring without intervention. Surface control of gas lift provides advantages that might not be immediately obvious, such as increased production, reduced Greenhouse Gas emissions, improved safety, better understanding of the reservoir, and increased ultimate recovery.

As the acceptance of digital intelligent artificial lift ("DIAL") and other intelligent completion technologies has grown over previous decades, so have the technological demands placed on them. Most widespread intelligent flow control systems have been almost exclusively dependent on hydraulic power as the motive force until recently. With the advent of more robust and proven electronics, technology is starting to shift towards electric systems for flow control. This electrical control has been essential for gas lift because multiple stations with multiple choke sizes can be controlled quickly with a single communication conduit downhole.

Drivers for Wireless Control:

The shift towards electric intelligent completions and gas lift has brought with it interest in wireless control of downhole systems. Wireless motoring systems have been installed in wells for decades and have a great track record for some specific scenarios, but flow control and varying well conditions bring additional complications to gas lift; such as (1) increased power requirements; (2) reduced production if a power harvester uses downhole flow for power generation; and (3) varied mediums can reduce communication depth, data rates, and reliability. In general, surface control gas lift system provides a great opportunity for new wells. However, there are thousands of older wells all of which require retrofit. Though these wells have various configurations, a wireless solution would enable control in many of them.

The following is a non-exhaustive list of examples of wireless communications that do not require EM waves. Ships and submarines use sonar to transmit through the ocean, which works well in expansive incompressible fluids. Measurement While Drilling (MWD) systems use distinct pressure pulses, which work well for incompressible liquids with significant energy. Some downhole gauge systems use acoustic signals through the tubing or casing, which can work well for shorter distances. Inductive systems have been utilized for extremely short distance. Others have used pressure perturbations, and some systems even pump or drop down RFID chips to send commands downhole. There are examples of noisemakers that are electrically regulated but amplified by flow to send a signal.

Each of these types of telemetry are well suited for specific environments. Some are good for gas, some are good to get through metal, some are good for short range, some are good for formations without salinity, others might be acceptable for some distance through saline fluids. Further, the range of data rates can vary from bits per day to megabits per second. The key is finding the communication scheme that is right for any particular situations. Sometimes that can include a combination of technologies for different locations or phases of a well. For instance, a well might use TEC for a main bore and inductive technology for the short hop to a multilateral zone.

Some environmental considerations that tend to determine the ideal form of telemetry for given conditions are salinity, gas liquid, multi-phase, compressibility, solids, ferromagnetic or conductive material, formation (if traveling outside of wellbore), and depth. Complicating things further, some of these factors might change over the life and stages of a gas lifted well. These stages are included in Table 1 and Table 2 below.

Also considered is that at some points in a well's life, communication may not be available at all. In such situations it is often desired to ensure that the system can be brought online and oil production and optimization resumed when desired.

Stages of a Gaslifted Well:

As previously mentioned, there are many stages in the life of a well. Types of wireless telemetry that best fits some set of stages might not work well in other stages. In some situations, they type of telemetry available for some stages might not be feasible with the limited power available. In the present disclosure is a wireless surface-controlled gas list system that is operational in all stages in a well's life despite limited band-with and delayed communications, loss of communication (temporary or permanent), These stages of a well's life to be considered are included in Table 1 and Table 2. These are separated into: (1) Production Stages: the stages of well production in which the well spend most of its life; and (2) Transitory Stages: the stages in which the well is transitioning (unloading, shut in, blowing down the annulus, etc).

TABLE 1

Production Life Stages of a Typical Gas Lift Well

| Phase | Name | Description | Tubing Fluid | Annulus Fluid | Flow |
|---|---|---|---|---|---|
| 1 | Initial Production | The well has recently been drilled, and no gas lift is required. | Oil/water | Completion Fluid | No annulus flow; tubing production |
| 2 | Initial Gas Lift | Annuus is being unloaded and there is multiphase gas/liquid flowing tubing | Multiphase gas/water/oil at top, oil/water at the bottom | Gas at the top, packer fluid at the bottom; gas flow | Annulus flow through intermediate valve; tubing production |
| 3 | Later Life Gas Lift | Annulus is unloaded to bottom valve, gas/liquid flowing in tubing | Multiphase gas/water/oil to lower station | Gas to lower station | Annulus flow through bottom valve; tubing production |

TABLE 2

Transitory Stages in a Typical Gas Lifted Well

| Phase | Name | Description | Tubing Fluid | Annulus Fluid | Gas Flow |
|---|---|---|---|---|---|
| T1 | Unloading, fluid in annulus | Various multiphase gas/liquid flow at varying level in tubing and gas/liquid interface at varying levels in the annulus | Multiphase Oil/water/gas | Completion Fluid/gas | Upper or intermediate valve; moves over process; tubing production |
| T2 | Unloading, no fluid in annulus | Annuus is filled with pressurized gas and there is multiphase gas/liquid flowing tubing | Multiphase gas/water/oil at top, oil/water at the bottom | Gas at the top, packer fluid at the bottom | Gas to level at which well was previous unloaded; tubing production |
| T3 | Stopping production; non-depleted | Liquid to surface in tubing, No flow from tubing | Probably water/oil surface | Probably completion fluid in the annulus | none |
| T4 | Stopping production | Gas from surface to water/oil interface in tubing; gas to completion fluid interface in annulus | Gas down to water/oil interface | Gas to depth of previous unload; pressurized | none |
| T5 | Blowing Down | Gas from surface to water/oil interface in tubing; gas to completion fluid interface in annulus | Gas down to water/oil interface | Gas to depth of previous unload; ambient pressure | Gas out of annulus; perhaps gas flow from tubing |
| T6 | Blown Down | Gas from surface to water/oil interface in tubing; gas to completion fluid interface in annulus | Gas down to water/oil interface | Gas to depth of previous unload; ambient pressure | none |

Power for a Wireless Solution:

Any wireless solution requires power to receive and interpret information and commands, take readings of its environment, actuate downhole mechanisms, and transmit information. This power can come from electrical storage downhole, electrical power generated downhole, mechanical or chemical energy storage, or a combination of the above.

Furthermore, any power system should consider the phase of a well's life to which it applies. If the well will be under constant production, perhaps no downhole power storage is required. If instead a well will sit dormant for long periods of time, more power storage will be required. There might even be cases where some portions of the same well might have different power requirements than other portions.

As with telemetry, Table 1 and Table 2 provide examples for determining relevant technologies over the life of the well once the project has been better defined and is underway.

Electrical Storage:

Batteries provide a very practical form of electrical storage downhole, but have limitations, of life span, size, and temperature ratings. Life and size go hand-in-hand. The battery's stored energy will drain with usage and time, but more batteries can be added to increase the energy capacity. However, that also increases the size of the overall package. When utilizing batteries downhole, temperature can also be a big factor. In the past it has been a struggle for batteries to operate for lengthy periods of time at temperature, but significant research has been going into battery technology of late. Options which include replacing battery packs via slickline or wireline have also been discussed in the industry.

Power Generation:

Electrical energy can be generated downhole for storage or immediate use. Dozens of ideas for downhole power generation have been researched and tested over the years including combinations of mechanical rotation, mechanical waves, thermoelectric, piezoelectric, and just about anything else that can be imagined.

Practical solutions for downhole power generation include a fluid or gas driven rotating device (such as a turbine) and a mechanical to electrical conversation device (such as an alternator). In general, devices such as downhole turbines are thought to have a limited life due to debris and general wear. Therefore, such devices have also been designed in formats such that moving parts can be removed and replaced via wireline when needed. Another shortcoming of any type of rotating device being driven by downhole fluids is the inherent restriction which reduces production potential. Some designs have provided a bypass when not needed or variable fins, both of which add complexity.

Mechanical and Chemical Energy Storage:

Power can also be stored via mechanical or chemical means. For downhole completion tools, mechanical energy storage has typically been in the form of atmospheric chambers and chemical energy storage in the form of power charges. In general both of these are used as motive forces rather than for communications, and both only supply a limited number of actuations. A rechargeable option includes a compressible fluid or one that energizes a hydraulic chamber with a piston acting against a spring.

Combinations of Power Storage and Generation:

Engineering considerations for power include storage and operating temperatures, mechanical envelope, using non-electric energy storage, lifetime, power requirements, fluid type, solids production, available flow, and available pressure differential. In examples, power is supplied downhole using downhole power generation and energy storage, and that considers requirements over the applicable stages of a well's life. In examples, the complete system is operated using battery power alone, which can be replaced by changing the batteries, some combination of downhole components, or the entire downhole assembly.

Mechanical Installation:

The mechanical system is optionally installed initially along with the production string or afterwards as a retrofit assembly. Installation with the production string is straight forward, and there are several options that will be mentioned for retrofit. As previously mentioned, examples of applying this disclosure include use in retrofit completions. Included is a straddle system along with a system meant to fit into standard side pocket mandrels. Hanging a system off of an anchor is another option. A through tubing straddle is a commercially available set of packers for sealing off an opening in a piece of tubing or casing. Auxiliary downhole components are optionally installed between these packers or below the anchor, in this case would include at least a power source, gas lift valve, and form of telemetry. Examples of these straddles include the BB and BR Straddles that are commercially available from Halliburton (www.halliburton.com).

A difference between these two solutions is the mechanical envelope. A straddle or anchor solution would offer more room for electronics, actuators, and batteries. Example visual summaries of each of these systems' installations are shown in FIGS. 1A-D and 2A/B. In FIGS. 1A-D that a retrofit side pocket mandrel system (FIG. 4) is preferable to a retrofit straddle from an installation perspective and flow perspective, but the side pocket solution is also technologically significantly more complex.

Another option utilizes a straddle to hold the power sources and use a lower tailpipe to hang off the gas lift valves. An advantage to such a system is that there is one power harvester through which all of the gas flow passes, and all of the other sections could share power via power generation and storage in this section (FIG. 6). While this system has some significant disadvantages, it does allow the non-flowing DIAL units to maintain power for telemetry and control. In examples a wet disconnect is included so that the upper portion can be removed and replaced. Each of these systems has their advantages and disadvantages, and an ideal solution might be a combination of some of these ideas. Alternately, some of the less technically advanced portions of a concept might be used as steppingstones along the progression to more technically advanced final solution.

Surface-controlled gas lift valves are available today. However, they require a form of communication from the surface to downhole equipment. Conventional gas lift systems with IPOs and PPOs are also available and require no communication, but they cannot be adjusted over time nor provide optimized production without intervention. Furthermore, they inherently limit production because they do not allow the full pressure available at the surface to maximize the depth of gas injection to the maximum possible depth.

The present disclosure provides an optimized solution while eliminating a mechanical or electrical conduit to the surface and allows for the use of slow telemetry that might not otherwise allow for fast enough closed loop control to meet the needs of a gas lift system. Surface-controlled gas lift with a hydraulic conduit or electrical line are used for optimized gas lift. However, the electrical line and/or hydraulic conduit limits its ability to be installed in retrofit applications or new completions which might now allow such electrical or hydraulic conduits. Conventional gas lift valves do not require an electrical or hydraulic conduit for control or feedback, but they also cannot be adjusted without pulling the completion. Furthermore, they inherently do not provide an optimized solution as they cannot allow gas to be injected at the deepest for a given available surface gas pressure. As previously discussed, wireless systems are also available, but many are too slow to allow for an efficient real time closed loop gas lift control system. Furthermore, they are not functional for all of the well stages listed in Table 1 and Table 2 above.

Examples of the system and method disclosed herein provides a gas lift system that is selectively autonomous, so that it can make its own decisions and take actions regarding closing, opening, or a variable choke rate of a valve through which lift gas is injected into a well. Similarly, in embodiments the system is imbued with means for operating autonomously when designated conditions are sensed in the well and otherwise act under the control of an operator or system processor. For the purposes of discussion herein, operating autonomously at certain times and at other times operation being controlled, is referred to as semi-autonomous. Examples of designated conditions include when communication between surface and downhole is suspended. Examples of operating autonomously include obtaining conditions in the well and imitating how an IPO (or PPO) valve would operate under the same or similar conditions in the well. In examples, the step of imitating includes use of a controller and/or processor downhole programmed to analyze wellbore conditions and identify a resulting action or operation of an IPO (or PPO) valve. The system can use downhole tubing pressure, annulus pressure, and temperature to make such decisions on its own, but the parameters affecting how it makes those decisions can be adjusted from the surface. Because real time decisions are being made downhole at the valves rather than the surface, the decisions can be made more quickly regardless of the potential use of a slow telemetry system. Instead, the telemetry system is used to adjust the parameters by which those decisions are made. Furthermore, the system does not require the same pressure reduction per station as required by conventional IPO systems (which are by far the most common systems used to date). Instead, the surface system can command downhole valves to lock open or closed at various points in the wells life to allow full surface pressure to be utilized and increase the depth of injection. The present disclosure provides the ability to install downhole gas lifted valves in a well that do not require electrical or hydraulic control lines. This allows these valves to be utilized in retrofit gas lift systems as well as completions that do not have the facility to provide well head penetrations for electrical or hydraulic conduits.

An advantage of the present disclosure is that well operations continue over a period of time when some types of communications are not operative at certain points in the well's life, such as when the well is shut in or when the well has various sets of fluids in its tubing or annulus. Some types of telemetry can communicate regardless of the well status. However, the system is programmable to act independently at times when the chosen communication system is unavailable until such a time that the communication can be regained. There are numerous systems available capable to provide communication between downhole tools and surface. An inexhaustive list of the technologies include electromagnetic signals, pressure pulses, pressure perturbations, acoustic signals in tubing, and even RFID chips. Some of these systems communicate one way and others communicate in two directions. However, none of these include a system with downhole equipment that can make its own decision as to when to provide an actuation, that decision being made using parameters of which can be adjusted from the surface.

The installation and means of conveyance are not critical nor are the types of downhole completion or workover equipment used. It can be installed on straddles, on an anchor, in a side pocket, or anything else appropriate. An advantage of the disclosed system and method is the wireless surface control of a downhole flow control system with limited or intermittent telemetry.

In one embodiment, this system includes individual surface-controlled gas lift stations and a processor with independent decision making ability that is optionally based on parameters related to pressures (tubing and annulus), temperatures, and any other sensor data available. Time is also a consideration. If the gas lift station has not received signals for some amount of time or infers that there is no production, it can act based on that each station has the ability to send and/or receive data and/or commands to/from the surface. The parameters controlling the actions of each gas lift station are selectively adjusted with commands from the surface. Additionally, each gas lift station is optionally, battery operated, has a power harvesting system, or both; equipped with one or more forms of telemetry; in communication with other gas lift stations so that signals sent by one gas lift station is receivable by another station.

To explain when a well operator might want to adjust the parameters of the semi-autonomous gas lift valve, some details are optionally considered regarding an IPO's operation. IPOs are carefully calibrated to open and close at a certain injection pressure. They begin to open when there is a high hydrostatic pressure in the annulus. Then they close as the well is unloaded and pressure drops in the tubing and annulus. This means that the available injection pressure at the surface needs to be well defined and not change over time. Sometimes there are situations where higher injection pressures may be available after an initial installation. Ideally, that additional injection pressure could be used to inject gas deeper in the production string and increase drawdown. Unfortunately, an IPO in the string eliminates the ability to utilize that extra gas pressure because an increase in annulus pressure will just cause an upper DIAL Unit to open and bypass the deeper IPOs and DIAL Units. In such a scenario, a signal could be sent down to the upper semi-autonomous gas lift valves to lock closed. Once locked, the surface injection pressure can be increased providing more pressure to the lower valves and deeper injection. Another option would be to send down a signal adjusting the operating parameters to a higher pressure. Once these upper semi-autonomous valves have locked closed or their values changed, another challenge can present itself. If the well is subsequently shut in and communications are interrupted, there may no longer be a way to unload the well to restart production since the upper valves may be locked shut or their parameters adjusted such that they cannot open with the available surface pressure. In such cases, a safety feature can be included to reset to conservative parameters under various situations such as: (1) senses no pressure in the annulus; (2) senses the same pressure in tubing and annulus for some amount of time; (3) senses more pressure in tubing than annulus; (4) receives some alternate type of communication applicable while shut in (large pressure pulse such as from an explosion or impact or implosion, or combination thereof, pump down RFID ball or tracer, etc.); (5) lack of a periodic signal to maintain the current set parameters; (6) something similar to the above; or some combination of the above.

To reiterate, some telemetry scenarios that are most applicable to gas lift wells might not be available during a temporary shut-in. Some examples for such situations might be a combination of one or more of the following, for example, if some valves have been locked closed, they can be reset by some non-production scenario, such as tubing pressure dropping or annulus pressure being blown down. That would open the valves and allow production to be restarted despite there being no communication. Another option is for the system to require a periodic signal from the telemetry system to maintain the adjusted parameters. If that signal is not received, the system would resort to the base parameters set for each surface-controlled semi-autonomous gas lift station. Another form of telemetry could be included for non-flowing situations (drop or pump something down tubing, pressure pulse, EM pulses, etc.). If tubing and annulus pressure are the same for some amount of time, the parameters would reset. An optional form of resetting to default values includes using available sensors, such as using pressure values to infer shut in or the lack of a signal to reset the adjusted parameters. In an example of resetting, operational parameters of the gas lift station are adjusted so that there is production from the well, or the well is capable of production. In some scenarios resetting involves the gas lift station identifying that the well is non-operational, such as due to a pressure setting in the gas lift station that either prevents an injection of lift gas, or allows an injection of lift gas that interferes with production from within the well (e.g., a gas lift station at a shallow location that is locked or in a failsafe mode to be full open or fully closed and prevents production from deeper in the well).

In alternatives, each gas lift valve does not act independently. For instance, they can be electrically connected to each other, and communicate to surface via a single wireless system. In this case, all units could share battery power or even energy harvesting when applicable as well as communicate directly with each other. There could also be a single logic module to direct the individual gas lift valves.

Another option would be to include the ability for individual semi-autonomous valves to receive signals (wireless or hard wired) from each other and act accordingly. The main adjustment typically available before an IPO installation is the test rack-opening pressure. However, there are variations in when the valves open, how much they open at certain pressures in the tubing and/or annulus, the differential pressure between the tubing and annulus, and the temperature. This is also true of when the valve closes. An example of the decision-making process described herein includes the portions of this IPO operation that are advantageous and leave off the portions that are deleterious.

This technology is also applicable to different sorts of downhole systems such as Interval Control Valves (ICVs), Inflow Control Devices (ICDs), Outflow Control Devices (OCDs), etc. In each of these, there would default operational values and instruction that could be overridden or adjusted by communications from the surface though they might not be the same as those for gas lift valves.

In an alternative, a low rate telemetry is used to optimize a well by moving some of the logic to semi-autonomous downhole units. Embodiments of a low rate telemetry include transmitting and/or receiving a data point per hour, per day, or slower; and examples of a data point include an instructional command, a response to a query for information (e.g., temperature, pressure, flow rate, etc.), or a signal acknowledging receipt of a communication. This means that despite low feedback rates on well conditions, the system is self-adjustable when there are sudden changes in injection pressure, reservoir pressure, injection rate, etc. At the same time, long term control parameter adjustments can be made to account for longer term changes in the reservoir such as depletion, change in water cut, or gas production. Furthermore, there are ways to reset these values to defaults in situations where communication is lost and the system needs to reset.

In an example embodiment this system includes: individual gas lift stations; operates on batteries; and acts like an idealized virtual IPO (each will have its own processor and can make decisions independently based on parameters related to pressures (tubing and annulus), temperatures, and any other sensor data available). The parameters controlling the actions of each downhole valve are selectively adjustable by commands from the surface. Examples include opening/closing pressures in tubing/annulus, amount of time pressures are at given levels before an action happens, or the amount it opens. The semi-autonomous valves can be reset to conservative values. For instance, it can reset if the valve has not received signals for some amount of time, infers that there are no communications, or determines the well is shut in. Each station has the ability to receive and possibly send data and/or commands to/from the surface, even if such information is slow and sporadic.

Another variation includes a series of stations connected via electric lines but with no communications conduit to the surface. In this situation stations could communicate with each other via the TEC but together would communicate to the surface with a wireless telemetry system. One generator and/or battery pack could be used to supply all stations. Though they would be programmed with logic not identical to PPOs, this is also applicable to ICVs, ICDs, OCDs, Circ Valves, etc.

In an alternative, when the wellbore is in a communication mode communication occurs between the surface and downhole valve, and when in a non-communication mode the downhole valve is out of communication with surface. In examples, the wellbore is in a communication mode when the wellbore is not producing, e.g., when no fluid is flowing in or being produced from the wellbore (such as when the wellbore is shut in). Alternatively, the wellbore is in a communication mode when the wellbore is producing, e.g., when fluid is flowing within or from the wellbore. In a further alternative, the wellbore is in a communication mode only when the wellbore is not producing or is shut-in, or only when the well is producing or not shut in. In an embodiment, operation of the downhole valve or of the wellbore does not change instantaneously with a change between a communication mode and a non-communication mode. Instead, a delay occurs, such as to allow for adjustments of the downhole valve when updated instructions or parameters are received downhole upon the change of a communication mode. In a non-limiting example of such a delay, the downhole valve operation is based on previously received parameters. Optionally, the downhole valve continues to operate based on the previously received parameters until an operational stage is completed, such as unloading of the wellbore (determined by time, pressures, temperatures, or some other signal) at which point the new parameters take effect. These parameters could adjust the open/close behavior of a valve or even lock the valve opened or closed. Further optionally, the data (e.g., pressure and temperature) is stored and sent when the wellbore is in a communication mode.

Referring now to FIG. 1, shown in a side sectional view is an example of a well system 10 that employs wireless communication for controlling lift gas injection. Included in well system 10 is a wellbore 12 shown intersecting a subterranean formation 14. Casing 16 lines the wellbore 12, and perforations 18 project radially through sidewalls of the wellbore 12 and past the casing 16 into the formation 14. Formation fluid F flows from the formation 16 and into a lower end the wellbore 12 through the perforations 18. In this example, the formation fluid F is a mixture of liquid (including water and hydrocarbons) and gas hydrocarbon. The formation fluid F is shown flowing upwards into production tubing 20 mounted in the wellbore 12 and within the casing 16. Lift gas valve units $\mathbf{22}_{1\text{-}n}$ are shown, which provide a way of injecting lift gas downhole. Communication units $\mathbf{23}_{1\text{-}n}$ are shown included with each of the lift gas valve units $\mathbf{22}_{1\text{-}n}$, which as explained in more detail below, provide for communication from surface to the lift gas valve units $\mathbf{22}_{1\text{-}n}$. As shown, lift gas valve units $\mathbf{22}_{1\text{-}n}$ are attached to an outer surface of the production tubing 20 and within an annulus 24 formed between the production tubing 20 and casing 16. In the example of FIG. 1, lift gas valve units $\mathbf{22}_{1\text{-}n}$ are referred to as digital intelligent artificial lift ("DIAL") units, and an example of a DIAL unit is described in Wygnanski, U.S. Pat. No. 8,925,638, and which is incorporated by reference herein its entirety and for all purposes. Lift gas valve units $\mathbf{22}_{1\text{-}n}$ selectively inject lift gas 26 from within the annulus 24 into the production tubing 20. The lift gas 26 forms bubbles within formation fluid F to reduce a density of formation fluid F, which promotes an upwards flow of the formation fluid F within the production tubing 20. The upwardly flowing formation fluid F and lift gas 26 reaches a wellhead assembly 28 shown at an upper end of the production tubing 20 and on surface, and is diverted into a production line 30 for offsite processing, storage, and/or transport. Lift gas valve units $\mathbf{22}_{1\text{-}n}$ are alternatively mounted within production tubing 20, and in some embodiments lift gas is provided from surface into the production tubing 20, and injected into the annulus 24 through the lift gas valve units $\mathbf{22}_{1\text{-}n}$.

The lift gas is injected into the wellbore 12 from a lift gas system 32, which includes a source of lift gas 34, such as a tank of natural gas, an adjacent well, or a transmission line, and an injection line 36 shown having an end distal from the tank 34 inside the wellbore 12. Optionally included with the system 10 are automatic gas lift valves $\mathbf{38}_{1,\ 2}$ inside the annulus 24 and having exit ports inside the production tubing 20 for delivering lift gas 26 into the production tubing 20. In embodiments gas lift valves $\mathbf{38}_{1,\ 2}$ are IPO and/or PPO type valves. Sensors 40, 42 are also in the wellbore 12, which sense conditions within the annulus 24, production tubing 26, or both. Example conditions include temperature, pressure, or both. In the example shown, sensors 40, 42 are in signal communication with a controller 44 on surface, and alternatively, are in wireless communication with one or more of the gas lift valve units $\mathbf{22}_{1\text{-}n}$. Communication lines 46,48, which in an example are elongated conducting members, are shown having ends connected with controller 44. In embodiments, the processor 44 is part of an information handling system, and further includes memory accessible by the processor, nonvolatile storage area accessible by the processor, and logics for performing each of the steps described herein. Opposing ends of one or both of lines 46, 48 are in communication with a modem 50 shown included with wellhead assembly 28, and alternative locations for modem 50 include, on surface and inside wellbore 12, such as proximate wellhead assembly 28. Ends of lines 46, 48 distal from controller 44 are optionally in communication with sensors 40, 42. Controller 44 is in selective wireless communication with one or more of valve units $\mathbf{22}_{1\text{-}n}$ via modem 50 and one or more of lines 46, 48. Examples of wireless communication include electromagnetic waves, acoustic waves, fluid pressure pulses, electrical signals through casing, acoustic signals through tubing, radio frequency identification ("RFID"), etc., and in the form of digital or analog data. For the purposes of discussion herein, wireless communication that transmits signals between the valve units $22_{1-n}$ and controller 44 at a rate and capacity for closed loop operation of the valve units $22_{1-n}$ is deemed high quality transmission.

Figure 1A:
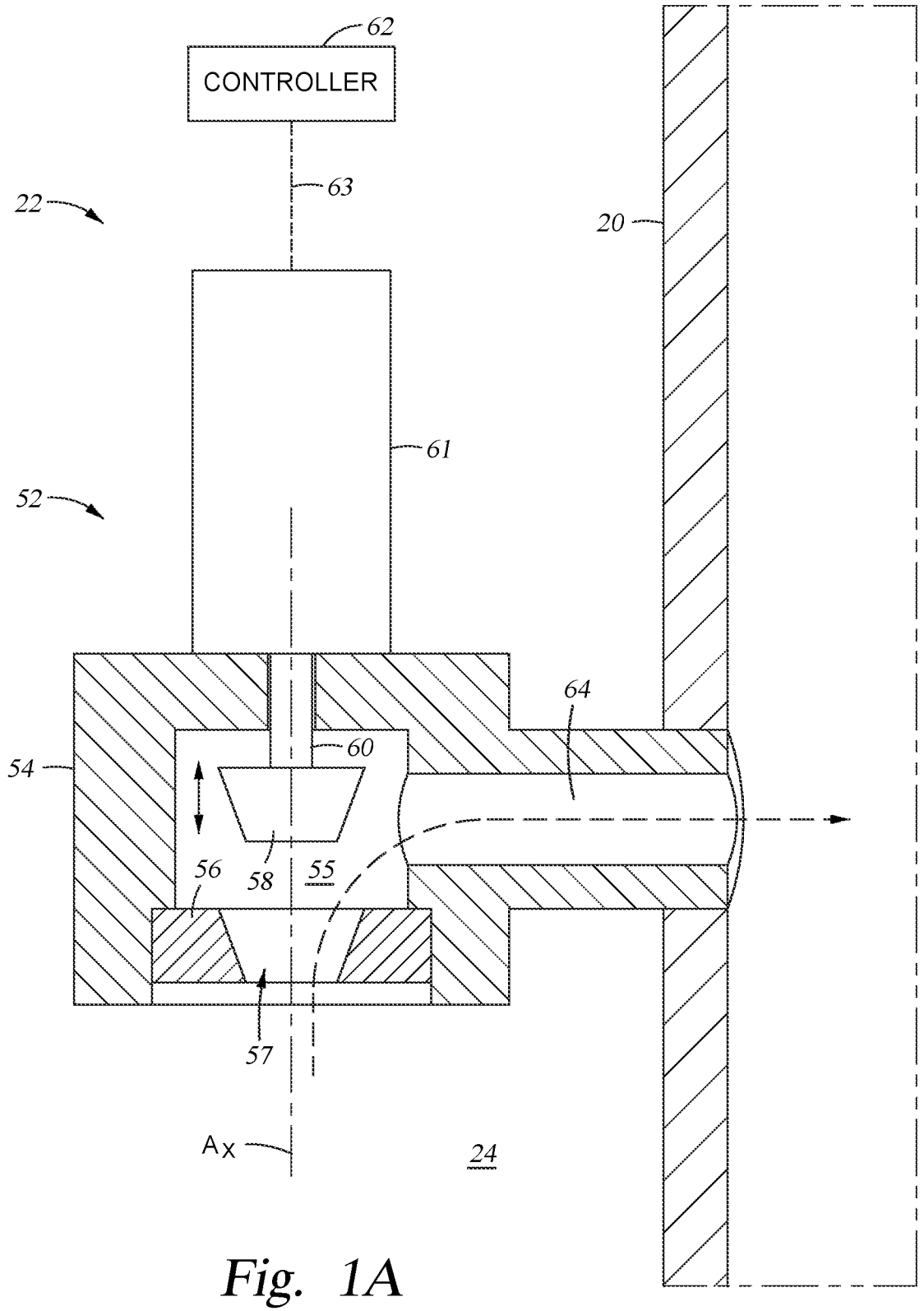
FIG. 1A is a side sectional view of an example of a valve assembly for use with the gas lift system of FIG. 1.

Referring now to FIG. 1A, shown in a side sectional is a schematic example of a valve assembly 52 portion of a lift gas valve unit 22, which includes a body 54 attached to an outer surface of production tubing 20. Within body 54 is a chamber 55 shown extending along an axis Ax of the valve assembly 52. A valve seat 56 is mounted inside the chamber 55, and shown having an opening 57. A plug 58 is selectively inserted into the opening 57 to define a closed configuration that blocks flow through the valve assembly 52, and selectively withdrawn from the opening 57 to define an open configuration that allows flow through the valve assembly 52. A choke flow is defined when plug 58 remains within a range of distances downstream of opening 57 so that the presence of plug 58 interfere with a full flow of fluid through opening 57. In an example, gas lift flow through the lift gas valve unit 22 is controlled by configuring valve assembly 52 in a choke flow configuration that results in a designated rate of flow through the unit 22. An end of a valve stem 60 attaches to the plug 58 on a distal side of the valve seat 56. An opposing end of the valve stem 60 couples with an actuator 61. Energizing the actuator 61 moves valve stem 60 towards or away from actuator 61, as illustrated by arrow, that in turn moves plug 58 into and out of opening 57. A controller 62 is shown in signal communication with actuator 61 via line 63, and which provides optional command signals to actuator 61 for operation of valve assembly 52. Controller 62 includes hardware and logics similar to those in controller 44 (FIG. 1), and further includes logics for autonomous operation of valve assembly 52, which in an example operate valve assembly 52 to function similar to that of an IPO type gas lift valve. A passage 64 is shown extending radially through body 54 and a sidewall of production tubing 20, through which chamber 55 is in communication with the inside of production tubing 20. Examples of operation of a surface-controlled gas lift valve, e.g., lift gas valve unit 22, include opening so that lift gas is injected downhole, closing to block an injection of lift gas, and restricting by opening the valve by an amount that controls the amount and/or rate of lift gas being injected,*

Figure 2A:
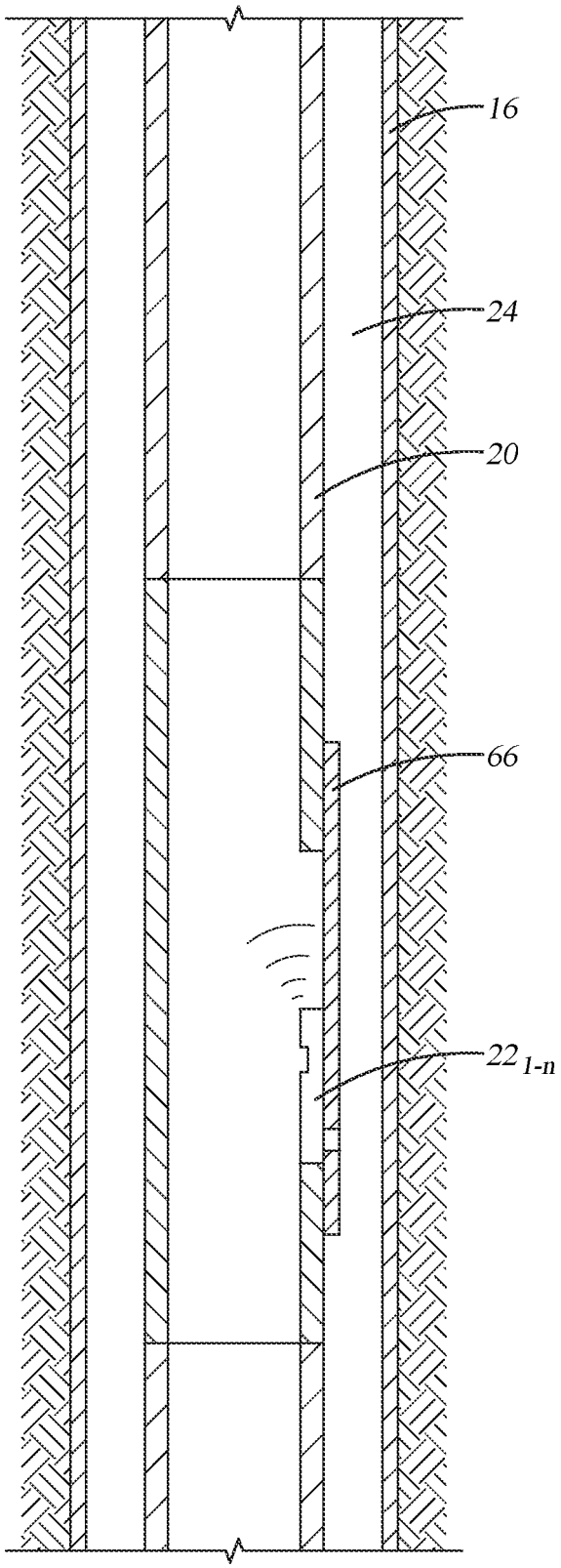
FIGS. 2A-2D are side sectional views of an example of replacing a lift gas valve unit in the gas lift system of FIG. 1.
Figure 2B:
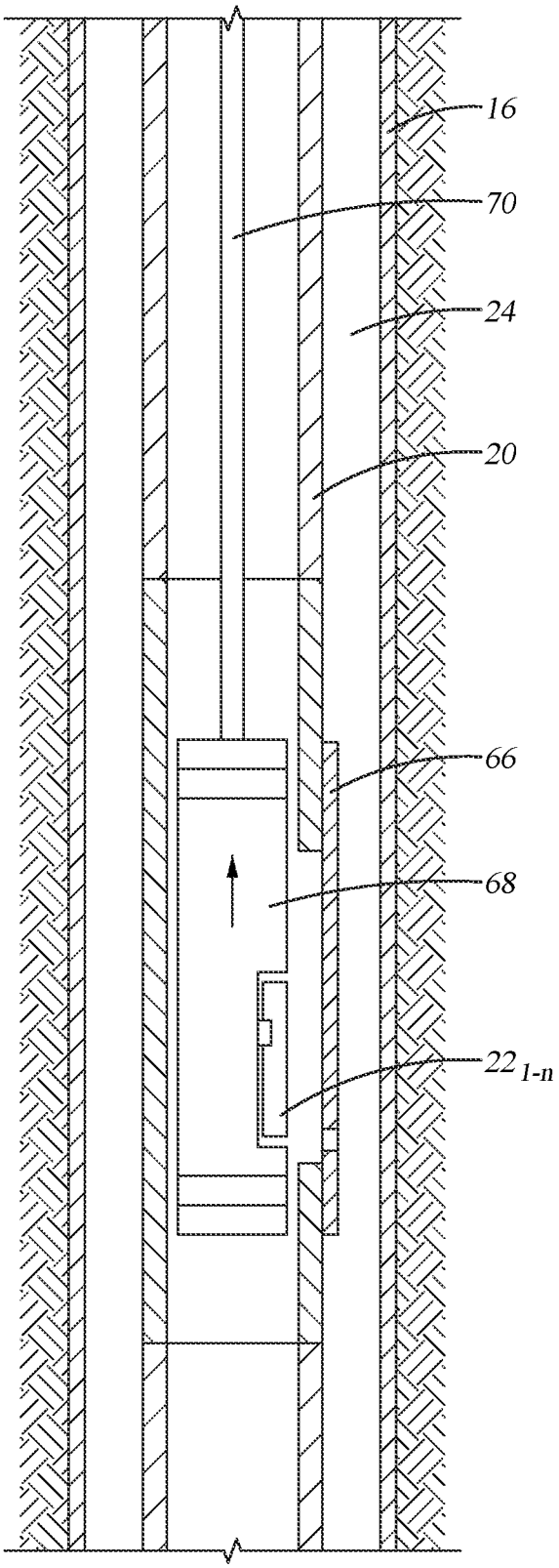
Figure 2C:
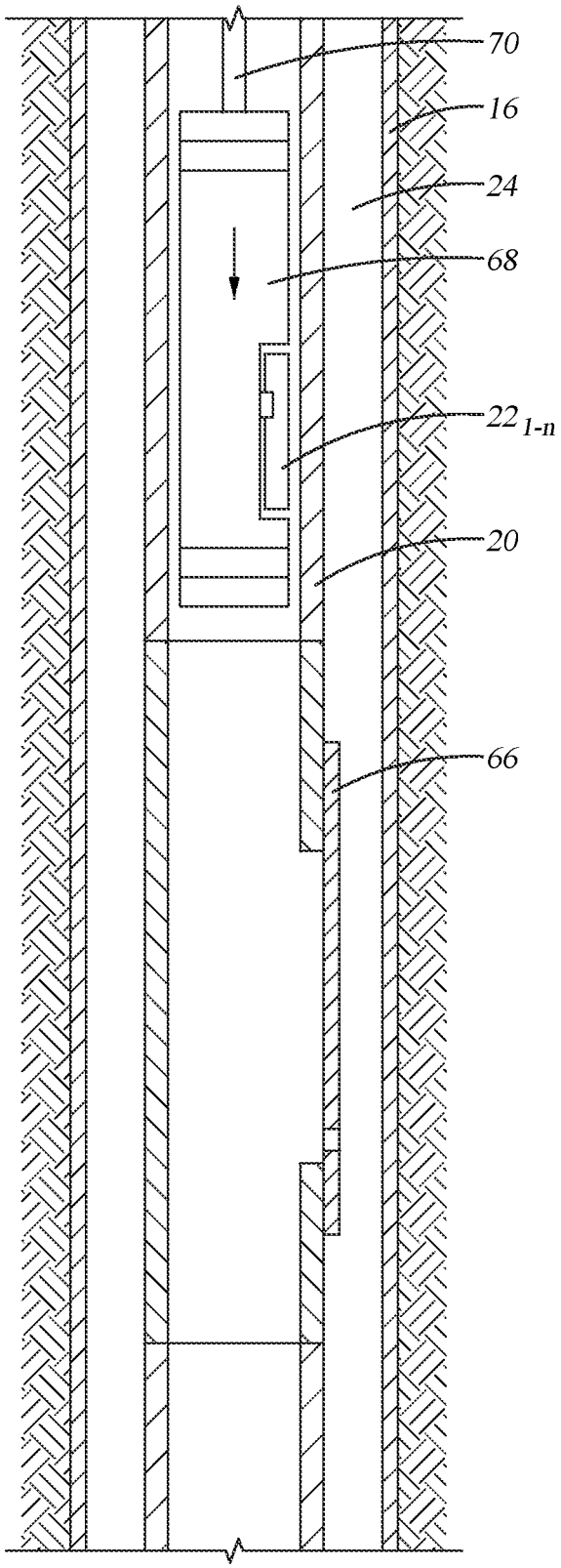
Figure 2D:
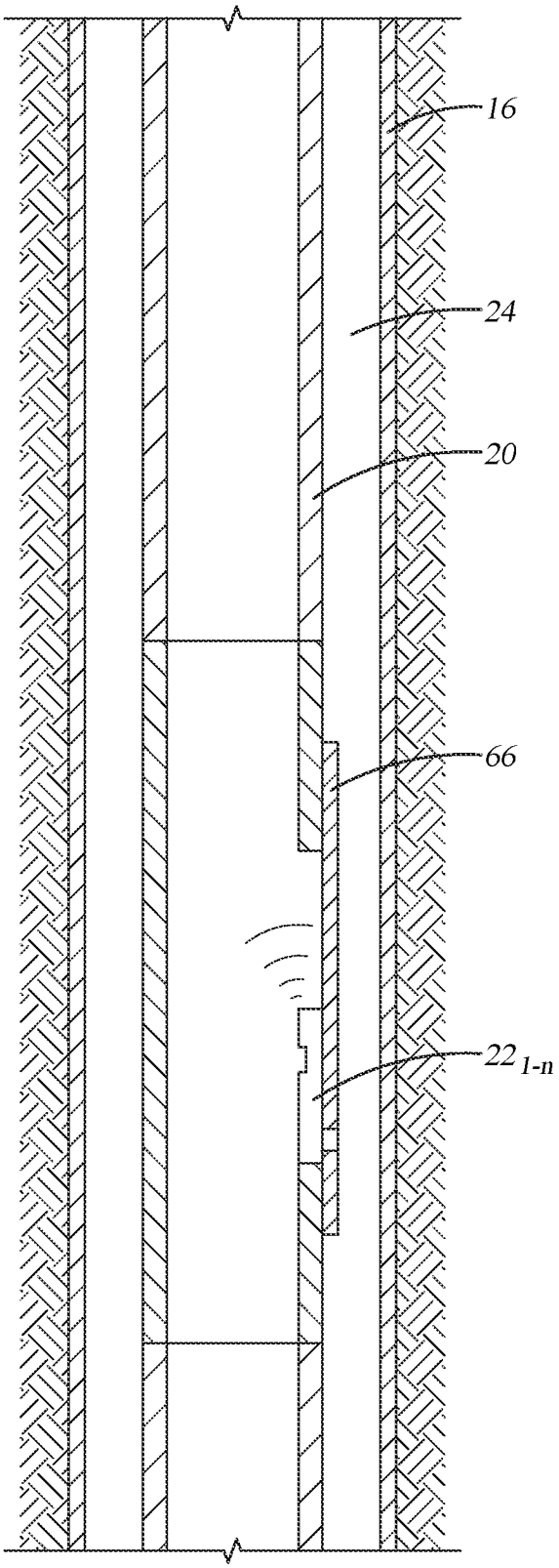

An advantage of one or more of valve units $22_{1-n}$ being in wireless communication with surface is that replacement does not require disconnection or reconnection of any hardwire communication lines. An example of replacing a one or more of the valve units $22_{1-n}$ is shown in a side sectional schematic view in FIGS. 2A-2D. In FIG. 2A, the one of the valve units $22_{1-n}$ is shown installed in a side pocket mandrel 66 that is coupled with production tubing 20, in this example the one of the valve units $22_{1-n}$ is in wireless communication with surface (as illustrated by the schematic representation of electromagnetic waves). In FIG. 2B, the one of the valve units $22_{1-n}$ has been detached from its installation in the side pocket mandrel 66 and by a running tool 68 deployed on wireline 70. In the example shown, the wireline 70, running tool 68, and the one of the valve units $22_{1-n}$ are being drawn upwards from within the production tubing 20. In a subsequent step, shown in FIG. 2C, a replacement for the one of the valve units $22_{1-n}$ is being lowered inside the production tubing 20 while attached to a lower end of the running tool 68, and in FIG. 2D, the replacement the one of the valve units $22_{1-n}$ is reinstalled in the side pocket mandrel 66.

Figure 3A:
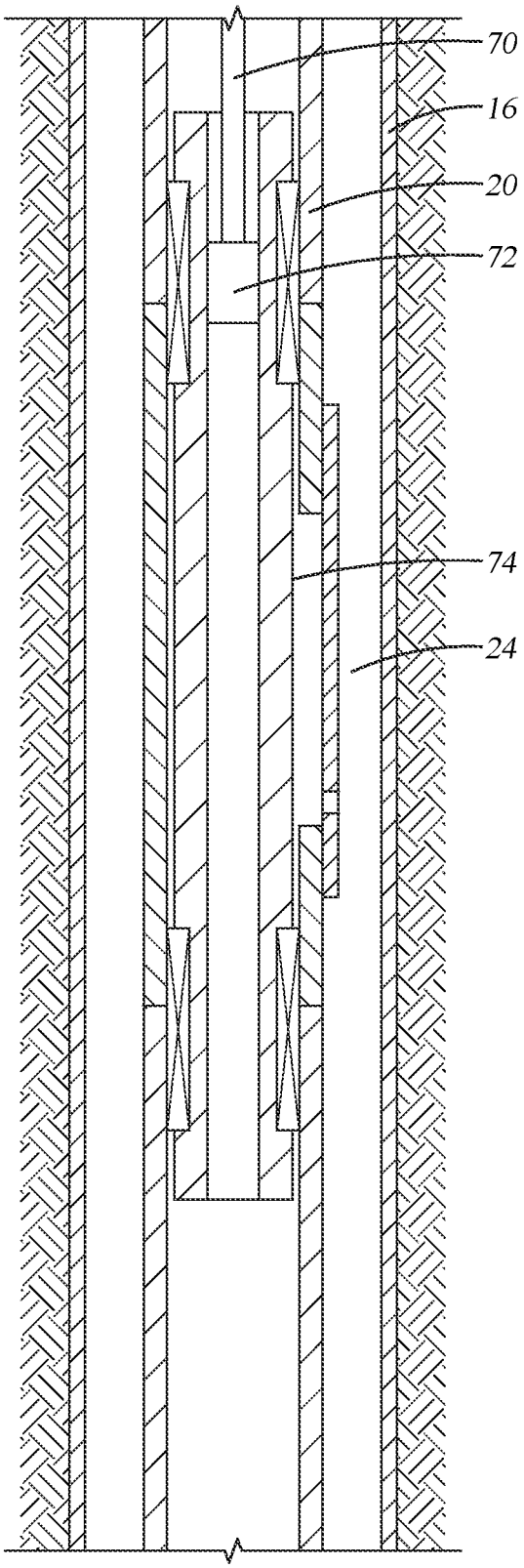
FIGS. 3A and 3B are side sectional views of an example of installing a lift gas valve unit that is within a straddle system.
Figure 3B:
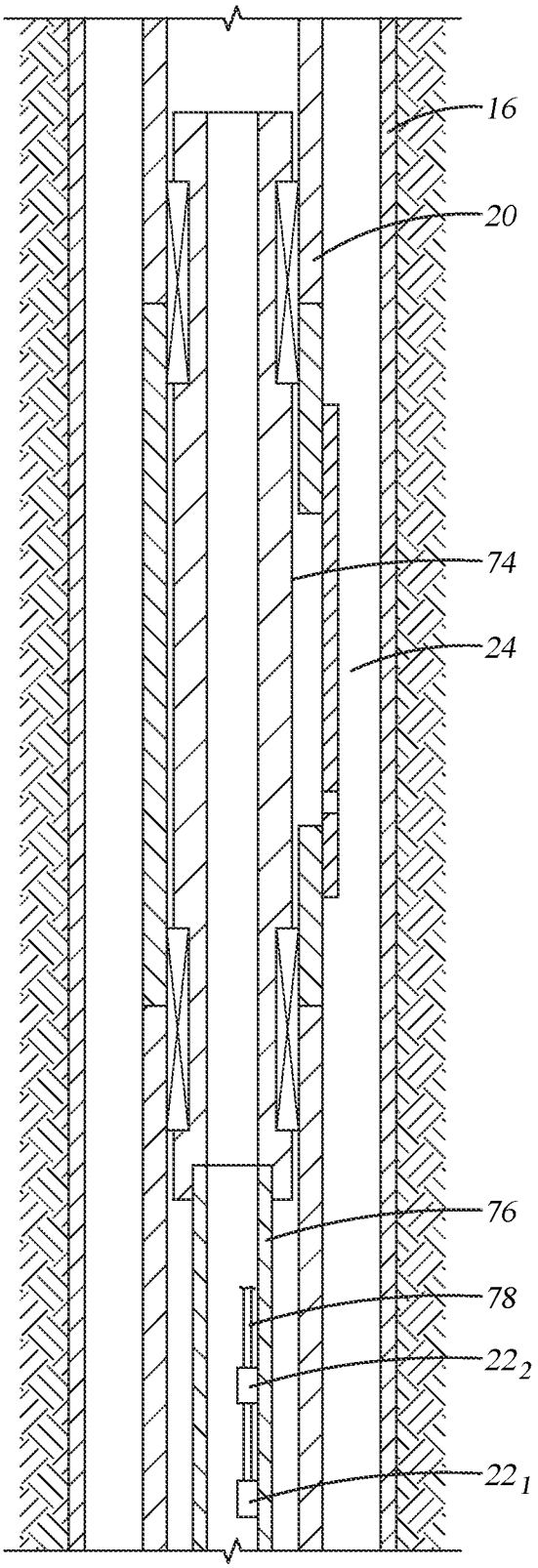

Alternatively, and as shown in a side sectional view in FIGS. 3A and 3B, a wireline 70 and running tool 72, are used to lower a straddle packer 74 within the production tubing 20. In this alternative, one or more of the valve units $22_{1-n}$ are installed inside the straddle packer 74 prior to deployment downhole. As shown in FIG. 3B, an optional tailpipe 76, which is an annular member, attaches to a lower end of the packer 74 and extends deeper into the wellbore 12. In the example of FIG. 3B, valve units $22_{1,2}$ are within tailpipe 76. Further optionally, a tubing encased conductor ("TEC") 78 connects between valve units $22_{1,2}$, and to other of the one of the valve units $22_{1-n}$ so that the valve units $22_{1-n}$ are in signal and data communication with one another.

In a non-limiting example of operation, lift gas 26 (FIG. 1) from the lift gas source 34 is injected into the annulus 24 of the wellbore 12 through line 36. Lift gas 26 in the annulus 24 is injected into the production tubing 20 through one or more of lift gas valve units $22_{1-n}$. Operation of the one or more lift gas valve units $22_{1-n}$ is selectively controlled by command signals communicated to the one or more lift gas valve units $22_{1-n}$ by wireless communication via communication units $23_{1-n}$. In alternatives, control of the one or more lift gas valve units $22_{1-n}$ includes commanding or instructing a time and duration of when the one or more lift gas valve units $22_{1-n}$ is to be in a particular configuration (i.e., open, closed, or choke flow). Further in this example, the controller 62 associated with each the one or more lift gas valve units $22_{1-n}$ includes logics to monitor for designated conditions under which to assume operational control of its associated one or more lift gas valve units $22_{1-n}$. The lift gas valve units $22_{1-n}$ optionally function substantially autonomously without constant supervisory control via wireless communication, and alter operation based on instructions stored on the controller 62 or in response to periodic commands received distally, such as from surface. In an embodiment of altering operation, updated instructions and/or adjusted operating parameters are generated by or stored by controller 44 (FIG. 1) and/or controller 62, which in examples alter commands or instructions transmitted for controlling the one or more lift gas valve units $22_{1-n}$. Examples of periodically include a minute or more, 30 minutes or more, hourly, daily, weekly, monthly, semi-annually, annually, and all time periods in between. In alternatives, the lift gas valve units $22_{1-n}$ begin operating substantially autonomously upon initial installation in the wellbore 12 and are under periodic control upon receiving signals transmitted distally. An advantage of substantially autonomous operation constant supervisory control is that even when communication is limited between surface and to the lift gas valve units $22_{1-n}$, so that closed loop control is not possible, production of hydrocarbons from the wellbore 12 can be optimized as the lift gas valve units $22_{1-n}$ have instructions to operate at an optimal capacity in the absence of constant communication from an operator or remote controller. Example designated conditions include a reduction of pressure in the production tubing 20, pressure in the annulus 24 being blown down (i.e., when gas injection ceases and pressure in the annulus 24 is released into injection line 36 of production tubing 20), if the period of time since the one or more lift gas valve units $22_{1-n}$ has received communication from surface exceeds a threshold time, if a designated signal is received by the one or more lift gas valve units $22_{1-n}$ (e.g., pressure pulse, an electromagnetic pulse, a signal from a radio frequency identification ("RFID"), a tracer, etc.), if pressure in the production tubing 20 equals or exceeds pressure in the annulus 24 for a period of time that exceeds a particular period of time. In an alternative, the designated condition(s) indicates a suspension or interruption of wireless communication between one or more lift gas valve units $22_{1-n}$ and surface; and one skilled in the art is capable of determining a threshold time and particular period of time that is a likely indicator of a suspension of wireless communication. The controller 62 also includes logics for the controller 62 to assume the operational control one or more lift gas valve units $\mathbf{22}_{1\text{-}n}$ when one or more of the designated conditions are identified by a controller 62. As noted above, the logics include instructions for autonomous operation of one or more lift gas valve units $\mathbf{22}_{1\text{-}n}$ without direction or instructions from an operator on surface or from controller 44, and where operation of one or more lift gas valve units $\mathbf{22}_{1\text{-}n}$ simulates or is the same as operation of an IPO gas lift valve. Embodiments of the autonomous operation of the one or more lift gas valve units $\mathbf{22}_{1\text{-}n}$ include wireless communication with one or more of sensors 40, 42 to receive signal data representing values of pressure and/or temperature measured in the wellbore 12 by sensors 40, 42, and adjusting gas lift operation based on the received signal data. In another embodiment, autonomous operation of the one or more lift gas valve units $\mathbf{22}_{1\text{-}n}$ include communication with other lift gas valve units $\mathbf{22}_{1\text{-}n}$, either via wireless communication or the TEC line 78. Logics in the controller 62 further include instructions to identify and recognize designated conditions for returning control of the one or more lift gas valve units $\mathbf{22}_{1\text{-}n}$ to an operator or the controller 44, such as upon a resumption of wireless communication between the one or more lift gas valve units $\mathbf{22}_{1\text{-}n}$ and surface and/or modem 50; and subsequently return control to the operator and/or controller 44.

Figure 4:
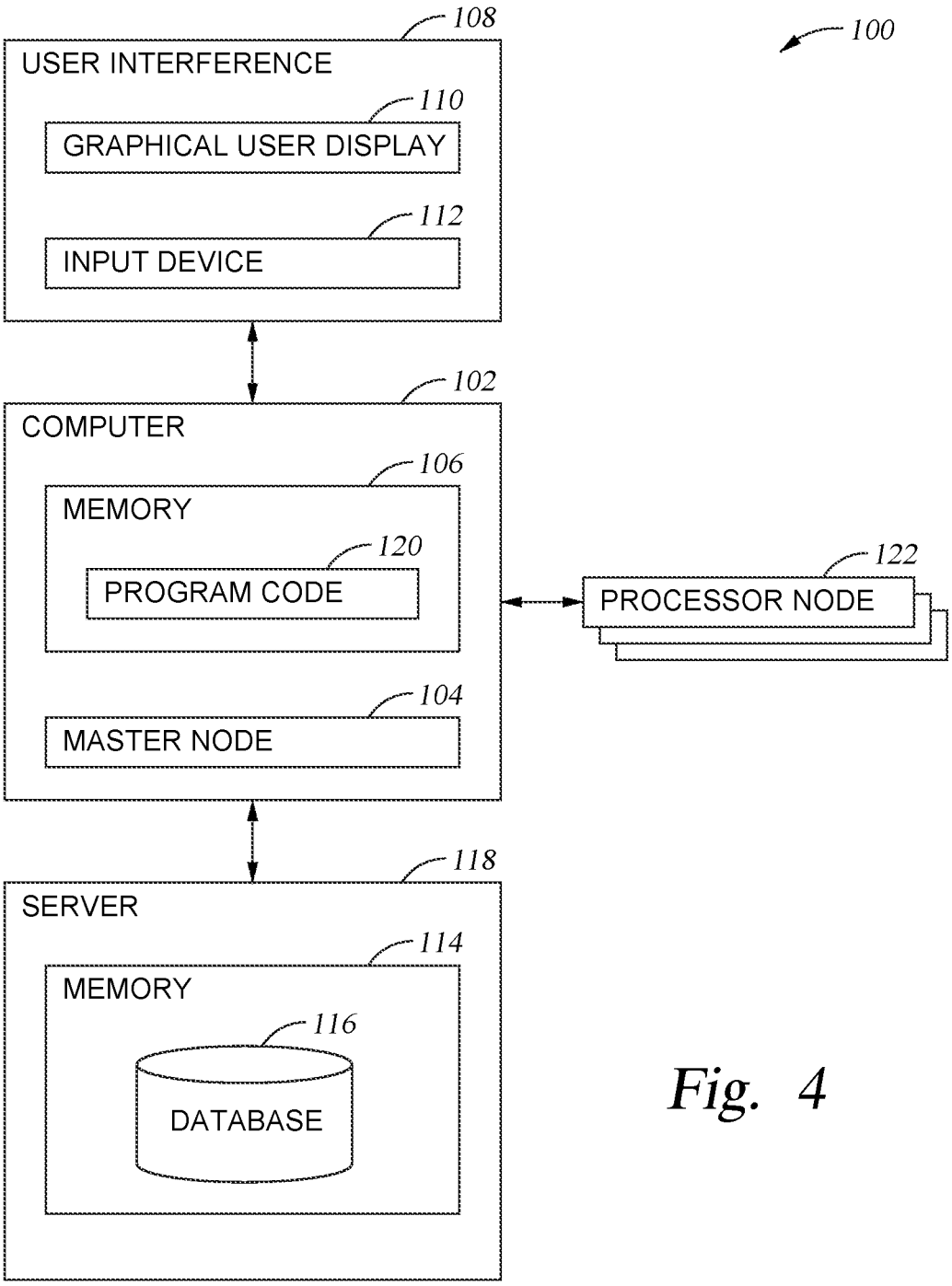
FIG. 4 is a block diagram of an example of a processor system for use with the valve assembly of FIG. 1.

Referring now to FIG. 4, shown in a block diagram form is an example of a processing system 100 that includes a computer 102 having a master node processor 104 and memory 106 coupled to the processor 104 to store operating instructions, control information and database records therein. Processing system 100 is optionally included with processor 62 (FIG. 1A) or in communication with processor 62. In examples, the processing system 100 is a multicore processor with nodes such as those from Intel Corporation or Advanced Micro Devices (AMD), or an HPC Linux cluster computer. The processing system 100 optionally is a mainframe computer of any conventional type of suitable processing capacity such as those available from International Business Machines (IBM) of Armonk, N.Y. or other source. Alternatively, the processing system 100 is a computer of any conventional type of suitable processing capacity, such as a personal computer, laptop computer, or any other suitable processing apparatus. It should thus be understood that a number of commercially available data processing systems and types of computers may be used for this purpose. The computer 102 is accessible to operators or users through user interface 108, which in alternatives is via controller 44 (FIG. 1), and available for displaying output data or records of processing results obtained according to the present disclosure with an output graphic user display 110. The output display 110 includes components such as a printer and an output display screen capable of providing printed output information or visible displays in the form of graphs, data sheets, graphical images, data plots and the like as output records or images. The user interface 108 of computer 102 also includes a suitable user input device or input/output control unit 112 to provide a user access to control or access information and database records and operate the computer 102. Processing system 100 further includes a database of data stored in computer memory, which may be internal memory 106, or an external, networked, or non-networked memory as indicated at 114 in an associated database 116 in a server 118. The processing system 100 includes executable code 120 stored in non-transitory memory 106 of the computer 102. The executable code 120 according to the present disclosure is in the form of computer operable instructions the implement some or all elements of the process 100 and cause the data processor 104 to determine designated conditions according to the present disclosure. Examples of executable code 120 include or in the form of microcode, programs, routines, or symbolic computer operable languages capable of providing a specific set of ordered operations controlling the functioning of the processing system 100 and direct its operation. In alternatives, the instructions of executable code 120 is stored in memory 106 of the processing system 100, or on computer diskette, magnetic tape, conventional hard disk drive, electronic read-only memory, optical storage device, or other appropriate data storage device having a non-transitory computer readable storage medium stored thereon. Executable code 120 is optionally contained on a data storage device such as server 118 as a non-transitory computer readable storage medium as shown. A non-transitory computer-readable storage medium includes a memory component, that is physical, on which information is stored, and where the information is in a digital format; examples of which include but are not limited to a magnetic storage device, flash memory, a CD, a DVD, a diskette, a tape, physical memory, or any other computer readable storage medium. Embodiments of the processing system 100 include a single CPU, or a computer cluster as shown in FIG. 4, including computer memory and other hardware to make it possible to manipulate data and obtain output data from input data. An example of a cluster is a collection of computers, referred to as nodes, connected via a network. Embodiments of a cluster include one or two head nodes or master nodes 104 used to synchronize the activities of the other nodes, referred to as processing nodes 122. The processing nodes 122 each execute the same computer program and work independently on different segments of the grid which represents the reservoir. The executable code 120 is optionally updated by sending signals, including wireless signals, to the controller 62 and/or processing system 100; in embodiments, the signals originate on surface and are transmitted under the direction of an operator of the wellbore 12 (FIG. 1). Examples of the executable code 120 include instructions for identifying a designated condition and the steps of the autonomous operation. In another alternative embodiment, parameters for autonomous operation of the one or more of the gas lift valve units $\mathbf{22}_{1\text{-}n}$ are automatically updated over the life of the well and to account for diminishing reserves in the adjacent formation 14 (FIG. 1).

The present invention described herein, therefore, is well adapted to carry out the objects and attain the ends and advantages mentioned, as well as others inherent therein. While a presently preferred embodiment of the invention has been given for purposes of disclosure, numerous changes exist in the details of procedures for accomplishing the desired results. Optionally, wireless signals are transmitted to one or more of the gas lift valve units $\mathbf{22}_{1\text{-}n}$ with commands to lock the valve in an open configuration, a closed configuration, or a choke configuration. Alternatively, the autonomous operation of one or more of the gas lift valve units $\mathbf{22}_{1\text{-}n}$ depends on the type of designated condition identified by the processing system 100 (or controller 62). For example, a designated condition of loss of communication could result in a "safe mode" autonomous operation in which the valve assembly 52 (FIG. 1A) is moved into a fully open/fully closed configuration, whereas a designated condition of one of the pressure differential scenarios is identified, the executable code 120 would have instructions for the one or more of the gas lift valve units $\mathbf{22}_{1-n}$ to operate as an IPO valve or an PPO valve, or some other type of operation, These and other similar modifications will readily suggest themselves to those skilled in the art, and are intended to be encompassed within the spirit of the present invention disclosed herein and the scope of the appended claims.

What is claimed is:

1. A computer implemented method of operating a well system comprising:

communicating between surface and a controller disposed inside of a wellbore, the controller having logics and configured to, monitor inside the wellbore, and when there is a suspension of wireless communication between surface and the controller, autonomously control operation of a lift gas valve unit disposed in the wellbore to operate the lift gas valve unit that opens autonomously in response to a designated opening pressure in the wellbore and closes autonomously in response to a designated closing pressure in the wellbore; and send a signal to the controller to adjust a value of the designated pressure in the production tubing.

2. The method of claim 1, wherein the lift gas valve unit comprises a valve assembly that includes a body coupled with the production tubing, a plug in the body, and an actuator, the valve assembly selectively changeable into an open configuration by energizing the actuator.

3. The method of claim 1, wherein the controller comprises a first controller and the lift gas valve unit comprises a first lift gas valve unit, the method further comprising communicating between surface and a second controller disposed inside of a wellbore, the second controller having logics and configured to monitor inside of the wellbore, and when there is a suspension of wireless communication between surface and the controller autonomously control operation of a second lift gas valve unit disposed in the wellbore.

4. The method of claim 3, wherein the designated opening pressure comprises a first valve designated opening pressure and a second valve designated opening pressure, the designated closing pressure comprises a first valve designated closing pressure and a second valve designated closing pressure, the first left gas valve is controlled to open in response to the first valve designated open pressure in an annulus between a production tubing and sidewalls of the wellbore and closes in response to the first valve designated closing pressure in the annulus, the second left gas valve is controlled to open in response to the second valve designated open pressure in the annulus and closes in response to the second valve designated close pressure in the annulus, the second lift gas valve unit is deeper in the wellbore than the first lift gas valve unit and the second valve designated closing pressure is lower than the first valve designated closing pressure.

5. The method of claim 3, wherein the designated opening pressure comprises a first designated opening pressure and a second valve designated opening pressure, the designated closing pressure comprises a first valve designated closing pressure and a second valve designated closing pressure, the first left gas valve is controlled to open in response to the first valve designated open pressure in a production tube and closes in response to the first valve designated close pressure in the production tube, the second left gas valve is controlled to open in response to the second valve designated open pressure in the production tube and closes in response to the second valve designated close pressure in the production tube, the second lift gas valve unit is deeper in the wellbore than the first lift gas valve unit and the second valve designated closing pressure is greater than the first valve designated closing pressure.

6. The method of claim 3, wherein the second lift gas valve unit is deeper in the wellbore than the first lift gas valve unit, and wherein logics are further configured to selectively lock the first lift gas valve unit in a closed configuration.

7. The method of claim 1, wherein the step of autonomously controlling operation of the lift gas valve unit occurs when the suspension of communication with surface exceeds a threshold time.

8. A non-transitory computer readable storage medium having executable code stored thereon for controlling an injection of lift gas into a wellbore, the executable code comprising instructions causing a processor inside the wellbore to perform operations comprising:

when communication with a controller on surface is suspended, autonomously controlling operation of a lift gas valve unit from within the wellbore to operate the lift gas valve unit by generating actuation signals causing the lift gas valve unit to open and close at designated opening and closing pressures in the wellbore;

communicating with surface to be reprogrammed with updated control parameters that are based on a change monitored in the wellbore;

operating using the updated control parameters;

resetting the control parameters to default control parameters; and operating using the default control parameters.

9. The non-transitory computer-readable storage medium of claim 8, wherein production tubing is disposed in the wellbore that forms an annulus between the production tubing and sidewalls of the wellbore, and the lift gas valve unit either opens in response to a first designated valve open pressure in the annulus and closes in response to a first designated valve close pressure in the annulus or opens in response to a second designated valve open pressure in the production tubing and closes in response to a second designated valve close pressure in the production tubing.

10. The non-transitory computer-readable storage medium of claim 8, wherein the lift gas valve unit comprises a first lift gas valve unit, wherein the executable code further comprises instructions causing the processor to send commands to the first lift gas valve unit to open in response to a first designated valve open pressure in an annulus formed between a production tubing and sidewalls of the wellbore and close in response to a first designated valve close pressure in the annulus, wherein the executable code further comprises instructions causing the processor to send commands to a second lift gas valve unit that is disposed deeper in the wellbore than the first lift gas valve unit, and to cause the second lift gas valve unit to open in response to a second designated valve open pressure in the annulus and close in response to a second designated valve close pressure in the annulus.

11. The non-transitory computer-readable storage medium of claim 10, wherein the commands to the first lift gas valve unit cause the first lift gas valve unit to close at the first designated valve closing pressure, and wherein the executable code further comprises instructions causing the processor to command the first lift gas valve unit to close at the second designated valve closing pressure that is greater than the first designated closing pressure.

12. The non-transitory computer-readable storage medium of claim 11, wherein the second designated closing pressure is based on conditions sensed real-time in the wellbore.

13. The non-transitory computer-readable storage medium of claim 8, wherein the lift gas valve unit comprises a first lift gas valve unit, and wherein the executable code further comprises instructions causing the processor to control a second lift gas valve unit.

14. The non-transitory computer-readable storage medium of claim 8, wherein the executable code is updated by a wireless signal.

15. A well system comprising:

production tubing in a wellbore;

an annulus between the production tubing and sidewalls of the wellbore;

a communication system that provides selective communication between surface and inside the wellbore that intersects a subterranean formation;

a processor in communication with the communication system, the processor disposed on the surface outside the wellbore; and a lift gas valve unit disposed in the wellbore, the lift gas valve unit comprising, a valve actuator, a valve member coupled with the valve actuator and selectively moveable in response to an operation of the valve actuator to an open configuration that allows fluid communication between the annulus and a bore of the production tubing and to a closed configuration that defines a barrier to fluid communication between the annulus and the bore of the production tubing, and a valve controller in operational communication with the valve actuator and programmable with commands for autonomous operation of the valve actuator when communication with the processor is suspended, the commands comprising, first instructions for the lift gas valve unit to cause the valve actuator to move the valve member into the open configuration when pressure in the annulus is at a first designated open pressure and to move the valve member into the closed configuration when pressure in the annulus is at a first designated close pressure, and second instructions for the lift gas valve unit to cause the valve actuator to move the valve member into the open configuration when pressure in production tubing is at a second designated open pressure and to move the valve member into the closed configuration when pressure in production tubing is at a second designated close pressure;

and wherein the valve controller selects either the first instructions or the second instructions.

16. The well system of claim 15, wherein the communication system comprises wireless telemetry, wherein the step of operating the lift gas valve unit that is disposed inside of the wellbore comprises wirelessly communicating signals from surface to the lift gas valve unit, and wherein the step of autonomously controlling operation of the lift gas valve unit occurs when a period of time of suspension of communication from surface exceeds a threshold time.

17. The well system of claim 15, wherein autonomously controlling operation of the lift gas valve unit is selectively adjusted by communication from surface to the processor based on a change in a well parameter selected from the group consisting of temperature in the wellbore, pressure in the wellbore, a flow of fluid in the wellbore.

18. The well system of claim 17, further comprising a second lift gas valve unit, wherein one or more of the first and second lift gas valve units are mounted on a tailpipe that depends from a straddle packer disposed in production tubing mounted in the wellbore.

19. The well system of claim 15, wherein the lift gas valve unit comprises a first lift gas valve unit and the closing pressure comprises a first valve closing pressure, the well system comprising a second lift gas valve unit having a second actuator and a second valve member, the second lift gas valve unit being disposed deeper in the wellbore than the first lift gas valve unit, the second lift gas valve unit is selectively controlled to cause the second valve actuator to close the second valve member at a second valve closing pressure in the annulus that is lower than the first valve closing pressure or to cause the second valve actuator to close the second valve member at a second designated closing pressure in the production tubing that is greater than the first valve designated closing pressure.

* * * * *